US009550598B2

(12) United States Patent
Penet et al.

(10) Patent No.: US 9,550,598 B2
(45) Date of Patent: Jan. 24, 2017

(54) FLATTENED CONTAINER COMPRISING AN ARCHED BOTTOM WITH SQUARE SEAT

(71) Applicant: SIDEL PARTICIPATIONS, Octeville sur Mer (FR)

(72) Inventors: Laurent Penet, Octeville sur Mer (FR); Pierrick Protais, Octeville sur Mer (FR); Michel Boukobza, Octeville sur Mer (FR)

(73) Assignee: SIDEL PARTICIPATIONS, Octeville, sur Mer (FR)

( * ) Notice: Subject to any disclaimer, the term of this patent is extended or adjusted under 35 U.S.C. 154(b) by 0 days.

(21) Appl. No.: 14/368,209

(22) PCT Filed: Feb. 7, 2013

(86) PCT No.: PCT/FR2013/050257
§ 371 (c)(1),
(2) Date: Jun. 23, 2014

(87) PCT Pub. No.: WO2013/121131
PCT Pub. Date: Aug. 22, 2013

(65) Prior Publication Data

US 2014/0374373 A1 Dec. 25, 2014

(30) Foreign Application Priority Data

Feb. 16, 2012 (FR) ..... 12 51437

(51) Int. Cl.
*B65D 1/02* (2006.01)
*B65D 1/42* (2006.01)

(52) U.S. Cl.
CPC ..... *B65D 1/0276* (2013.01); *B65D 2501/0081* (2013.01)

(58) Field of Classification Search
CPC ... B65D 1/0276; B65D 1/0261; B65D 23/001; B65D 23/00; B65D 2501/0081
(Continued)

(56) References Cited

U.S. PATENT DOCUMENTS 4,197,954 A * 4/1980 Oltman et al. ..... 215/373
4,502,607 A 3/1985 Szajna
(Continued)

FOREIGN PATENT DOCUMENTS

EP 0 130 023 A2 1/1985
JP 02-144507 U 12/1990
(Continued)

OTHER PUBLICATIONS

International Search Report for PCT/FR2013/050257 dated Apr. 16, 2013.

*Primary Examiner* — J. Gregory Pickett
*Assistant Examiner* — Niki M Eloshway
(74) *Attorney, Agent, or Firm* — Sughrue Mion, PLLC

(57) ABSTRACT

Container of plastic material having a flattened body and a bottom in the extension of the body having peripheral seat defining a seating plane the contour of which has in the same plane a large dimension A1 and a small dimension A2 that is strictly smaller than the large dimension, and an inner annular cheek substantially perpendicular to the seating plane. The bottom having a concave arch that extends from the seat towards a central zone. A height H of the cheek and a width L of the seating plane are such that $$0.5 \leq \frac{L}{H} \leq 2.5.$$

(Continued)

A transverse extension A of the seating plane and a transverse extension B of the body, measured near the bottom, are such that $$\frac{A}{B} \geq 0.85.$$

12 Claims, 2 Drawing Sheets

(58) Field of Classification Search
USPC ..... 215/373, 374, 376
See application file for complete search history.

(56) References Cited

U.S. PATENT DOCUMENTS

| | | | | |
|---|---|---|---|---|
| 7,150,371 | B1 * | 12/2006 | Larson et al. | 215/373 |
| 2002/0148805 | A1 * | 10/2002 | Wurster et al. | 215/374 |
| 2004/0164045 | A1 * | 8/2004 | Kelley | 215/373 |
| 2010/0000963 | A1 | 1/2010 | Inomata et al. | |
| 2013/0153530 | A1 * | 6/2013 | Boukobaz et al. | 215/376 |
| 2014/0209558 | A1 * | 7/2014 | Wright et al. | 215/376 |

FOREIGN PATENT DOCUMENTS

| | | | |
|---|---|---|---|
| JP | 05-51716 | U | 7/1993 |
| JP | 2011-251519 | A | 12/2011 |
| JP | 2011-251756 | A | 12/2011 |
| WO | 2007/127789 | A1 | 11/2007 |

* cited by examiner

FLATTENED CONTAINER COMPRISING AN ARCHED BOTTOM WITH SQUARE SEAT

CROSS REFERENCE TO RELATED APPLICATIONS

This application is a National Stage of International Application No. PCT/FR2013/050257 filed Feb. 7, 2013, claiming priority based on French Patent Application No. 1251437, filed Feb. 16, 2012, the contents of all of which are incorporated herein by reference in their entirety.

The invention relates to the field of containers obtained by blowing or stretch blow-molding from a blank (for example a preform or intermediate container) of plastic material such as PET (polyethylene terephthalate).

The invention relates more particularly to flat containers, namely containers having a flattened cross section, typically oval or rectangular in shape. This type of container is especially suitable for some applications (particularly cosmetics) in which the contents have a high viscosity, so that pressure on the body of the container causes the contents to flow.

However, this type of container is not limited to cosmetics applications, and for ergonomic reasons, it is also used in the packaging of beverages, the flattened section offering a better grip, as explained in the international application WO 2007/127789 (The Coca-Cola Company) or its American equivalent US 2010/0000963.

Nevertheless, this ergonomic advantage also has a mechanical disadvantage: instability, due to the flattening of the container which increases the risk of tipping in an axial plane parallel to the smaller width of the container.

The stability of the container is inversely proportional to its facility of grip. It is a compromise between these two limitations that resulted in the solution explained in the aforementioned document, which proposes on the one hand to maintain the W/D ratio (where W is the larger width of the container, and D is its smaller width) between 1.2 and 1.8, and on the other hand to provide the bottom of the container with rounded chamfers (sic) the diameter of which is smaller in the small width of the container than in the larger width of the container.

In reality, this solution contributes only a partial response to the instability problem that affects flat containers. In practice, it is seen that the natural instability (due to the flat shape) of such a container is frequently compounded by instability due to defects of shape on the bottom.

Indeed, during the forming of a flat container it is stretched farther in the direction of its larger width than in the direction of the smaller width. This variation of the stretching rate can induce undesirable defects of flatness on the bottom.

A first simple solution could consist of increasing the blowing pressure, but manufacturers are faced with the need to control the energy consumption of the machines, thus requiring low blowing pressure.

A second simple solution could consist of increasing the blowing time (and thus increasing the cycle time) in order to promote a better impression of the bottom, but this solution is also faced with process limitations which seek to decrease the cycle time in order to increase production rates.

What remains, therefore, is to optimize the shape of the bottom.

The invention seeks to propose a flat container capable of fulfilling one or more (and preferably all) of the following objectives:

- good stability;
- good compromise between ergonomics and stability;
- good blowability;
- absence (or near-absence) of flatness defects on the bottom.

To that end, proposed firstly is a container of plastic material having a flattened body and a bottom in the extension of the body at a lower end thereof, the bottom comprising:

- a peripheral seat defining:
  - a seating plane the contour of which has in the same plane a large dimension A1 and a small dimension A2 that is strictly smaller than the large dimension, and
  - an inner annular cheek substantially perpendicular to the seating plane;
- a concave arch that extends from the seat towards a central zone.

In this container:

- a height H of the cheek and a width L of the seating plane are such that:

$$0.5 \leq \frac{L}{H} \leq 2.5$$

- a transverse extension A of the seating plane and a transverse extension B of the body, measured near the bottom, are such that:

$$\frac{A}{B} \geq 0.85$$

Dimensioned in this way, the container offers a better compromise between ergonomics and stability.

Various characteristics can be provided, alone or in combination:

- a small dimension A2 of the seating plane and a small dimension B2 of the body near the bottom are such that:

$$\frac{A2}{B2} \geq 0.90$$

- the small dimension A2 of the seating plane and the small dimension B2 of the body near the bottom are such that:

$$\frac{A2}{B2} \cong 0.95$$

- the seating plane has, parallel to the large dimension, a maximum width L1, and parallel to the small dimension, a minimum width L2 such that:

$$\frac{L1}{L2} > 1$$

- the maximum width L1 and the minimum width L2 of the seating plane are such that:

$$1 < \frac{L1}{L2} < 3$$

the maximum width L1 and the minimum width L2 of the seating plane are such that:

$$\frac{L1}{L2} \cong 2$$

the cheek has, parallel to the large dimension, a maximum height H1, and parallel to the small dimension, a minimum height H2 such that:

$$\frac{H1}{H2} < 1$$

the minimum height H1 and the maximum height H2 of the cheek are such that:

$$0.5 < \frac{H1}{H2} < 1$$

the minimum height H1 and the maximum height H2 of the cheek are such that:

$$\frac{H1}{H2} \cong 0.95$$

the large dimension A1 and the small dimension of the seating plane are such that:

$$\frac{A1}{A2} > 1.5$$

and preferably:

$$\frac{A1}{A2} > 1.8$$

at any point M on an outer perimeter of the seating plane, the width $L_M$ of the seating plane is such that:

$$\frac{1}{15} \leq \frac{L_M}{C_M} \leq \frac{1}{5}$$

where $C_M$ is the distance from the point M to an axis of the container.

Other objects and advantages of the invention will be seen from the description of a preferred embodiment, provided with reference to the appended drawings in which.

Figure 1:
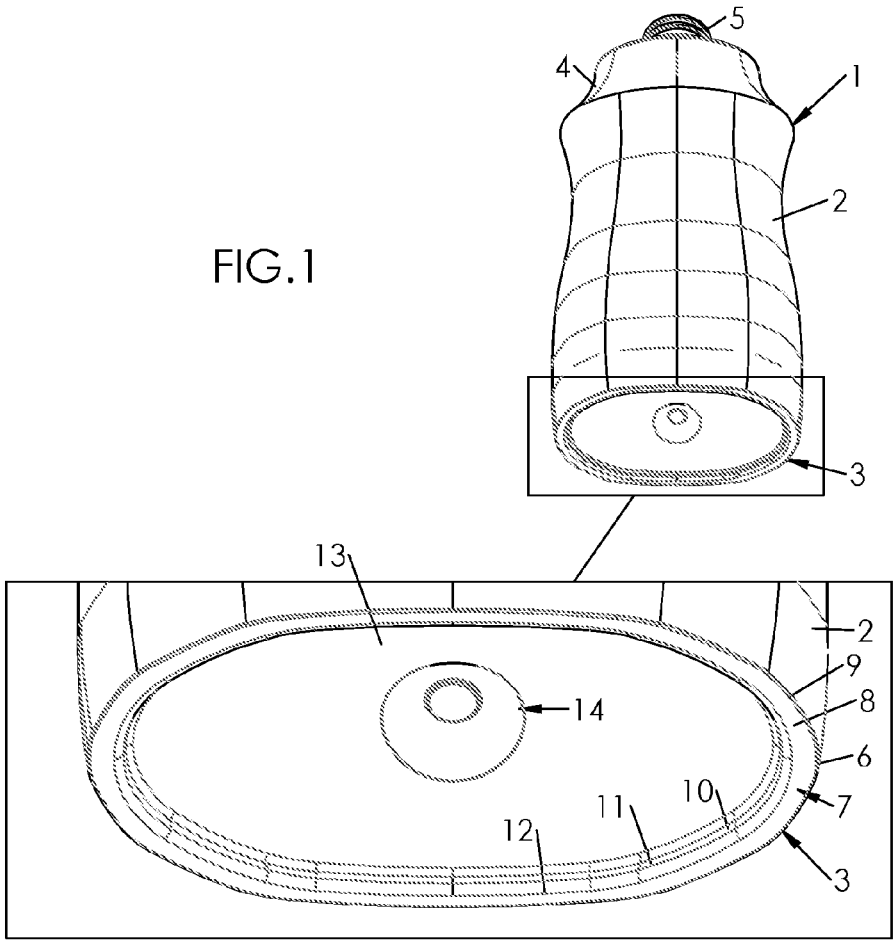
FIG. 1 is a view in perspective from below of a container of plastic material, with an inset in larger scale detailing the bottom of the container.

Represented in FIG. 1 is a container 1 formed by stretch blow-molding, in a mold with the impression of the container 1, from a preform in plastic material such as PET (polyethylene terephthalate).

The container 1 comprises a body 2 which extends along a principal axis X and is extended, at a lower side, by a bottom 3, and an upper side, opposite to the bottom 3, by a shoulder 4 which in turn is extended by a neck 5 defining a mouth.

The body 2 has a cross-section that is flattened in shape, in this instance substantially oval. This shape extends to the bottom 3, the contour of which is substantially the same as the body 2 in cross-section.

At the junction between the body 2, at the lower end thereof, and the bottom 3, the container 1 has an outer connecting fillet 6 having an arc-of-circle profile of small radius (equal to or less than 2 mm).

The bottom 3 comprises a peripheral seat 7 which defines a continuous seating plane 8, substantially perpendicular to the principal axis X of the container 1, and by which said container can rest flat on a flat surface (particularly the upper surface of the table or a conveyor belt, in a handling machine on a container production line).

The seating plane 8 is transversely delimited towards the exterior (i.e. opposite the axis X of the container) by an outer perimeter 9 defined internally by the fillet 6.

A transverse extension of the seating plane 8 is denoted A, measured perpendicularly to the principal axis X of the container 1 at the outer perimeter 9. Because the seating plane 8 has an oval contour, A is not constant and has a maximum, called large dimension and denoted A1, and a minimum, called small dimension and denoted A2, the ratio of which must be greater than 1:

$$\frac{A1}{A2} > 1$$

More specific examples of this ratio will be provided hereinafter.

Furthermore, B denotes a transverse extension (or width) of the body 2 measured perpendicularly to the principal axis X of the container, near the bottom 3, i.e. at a distance from the seating plane 8 that is less than or equal to ⅕ of the total height of the body 2. Since the body 2 in cross-section has an overall contour like the bottom 3, B is not constant and has a maximum B1, called large dimension of the body and a minimum B2, called small dimension of the body, the ratio of which must be greater than 1:

$$\frac{B1}{B2} > 1$$

The seat 7 comprises an inner annular cheek 10 which extends axially towards the interior of the container 1 in the extension of the seating plane 8, substantially perpendicular with respect thereto. The seating plane 8 is connected to the cheek 10 by an inner fillet 11 having an arc-of-circle profile of small radius (equal to or less than approximately 2 mm), or a medium radius (of between approximately 2 mm and 5 mm).

The seating plane 8 is transversely delimited towards the interior (i.e. in the direction of the axis X of the container) by an inner perimeter 12 defined externally by the inner fillet 11.

The bottom 3 further comprises a concave arch 13, with the concavity turned outward from the container 1. Said arch 13 extends from the seat 7, in the extension of the cheek 10, to a central zone of the bottom defining a disc 14 that extends axially, projecting towards the interior of the container 1.

The following notation is used:

H is the height of the cheek 10 (taken together with an internal height of the seat 7), measured axially between the seating plane 8 and the junction of the cheek 10 with the arch 13;

L is a width of the seating plane 8 (taken together with a width of the seat 7), measured radially between the inner perimeter 12 and the outer perimeter 9.

The bottom 3 is dimensioned as follows:

on the one hand, the height H of the cheek 10 and the width L of the seating plane 8 are such that:

$$0.5 \leq \frac{L}{H} \leq 2.5$$

on the other hand, the transverse extension A of the bottom 3 and the transverse extension B of the body 2 near the bottom 3 are such that:

$$\frac{A}{B} \geq 0.85$$

This dimensioning significantly increases the stability of the container 1.

The ratios A1/B1 and A2/B2 can be dimensioned separately; they can be substantially identical:

$$\frac{A1}{B1} \cong \frac{A2}{B2}$$

Figure 3:
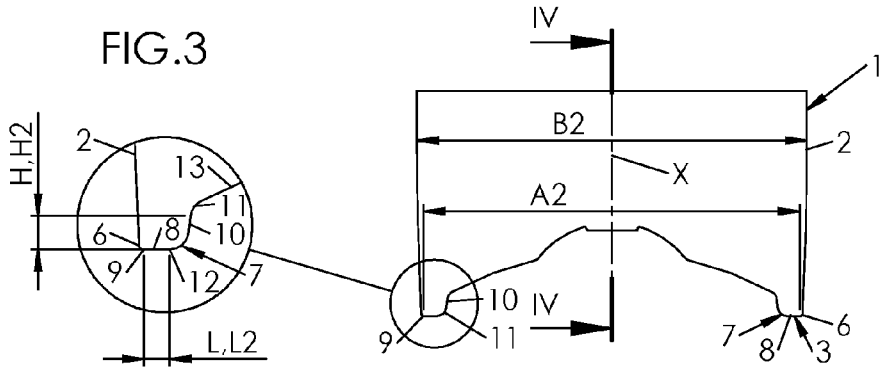
FIG. 3 is a detailed view in cross-section of the container of FIG. 2, along cutting plane III-III.
Figure 3:
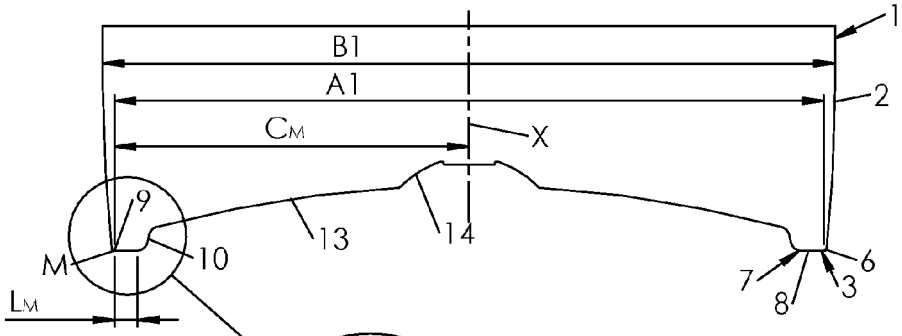

According to a preferred embodiment, the ratio A2/B2 is equal to or greater than 0.90, and for example substantially equal to 0.95, as illustrated in FIG. 3:

$$\frac{A2}{B2} \geq 0.90$$

and for example:

$$\frac{A2}{B2} \cong 0.95$$

This dimensioning, which moves the outer perimeter 9 of the seating plan 8 outwards, that is, opposite to the axis X, gives the container 1 a substantially cylindrical shape near the bottom 3. The result is increased stability of the container 1 in the plane of the small dimension A2.

Figure 4:
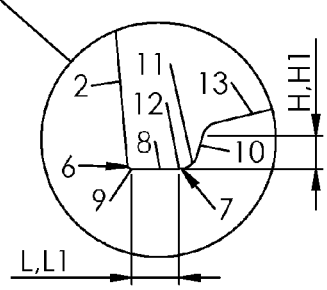
FIG. 4 is a detailed view in cross-section of the container of FIG. 3, along the cutting plane IV-IV.
Figure 5:
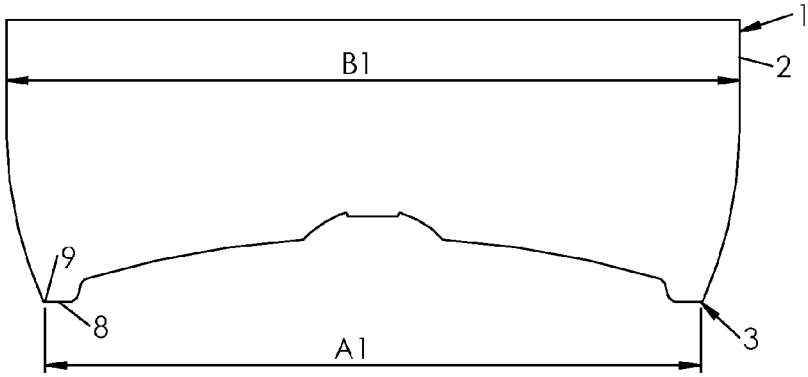
FIG. 5 is a view similar to FIG. 4, according to a variant of embodiment.

The ratio A1/B1 can also be equal to or greater than 0.90, and for example substantially equal to 0.95, as illustrated in FIG. 4:

$$\frac{A1}{B1} \geq 0.90$$

and for example:

$$\frac{A1}{B1} \cong 0.95$$

As a variant, the ratios A1/B1 can be different, the ratio A1/B1 preferably being less than the ratio A2/B2:

$$\frac{A1}{B1} < \frac{A2}{B2}$$

Thus, the ratio A2/B2 being maintained equal to or greater than 0.90, and for example substantially equal to 0.95 as illustrated in FIG. 3, the ratio A1/B1 is then less than 0.90, and for example substantially equal to 0.89, as illustrated in FIG. 4:

$$\frac{A1}{B1} < 0.90$$

and for example:

$$\frac{A1}{B1} \cong 0.89$$

This makes it possible to maintain the stability of the container 1 in the plane of the small dimension A2 (high A2/B2 ratio), while maintaining good blowability of the container (relatively low A1/B1 ratio) in the plane of the large dimension A1, where the stretching is more difficult but where the stability of the container 1 is naturally better.

Figure 2:
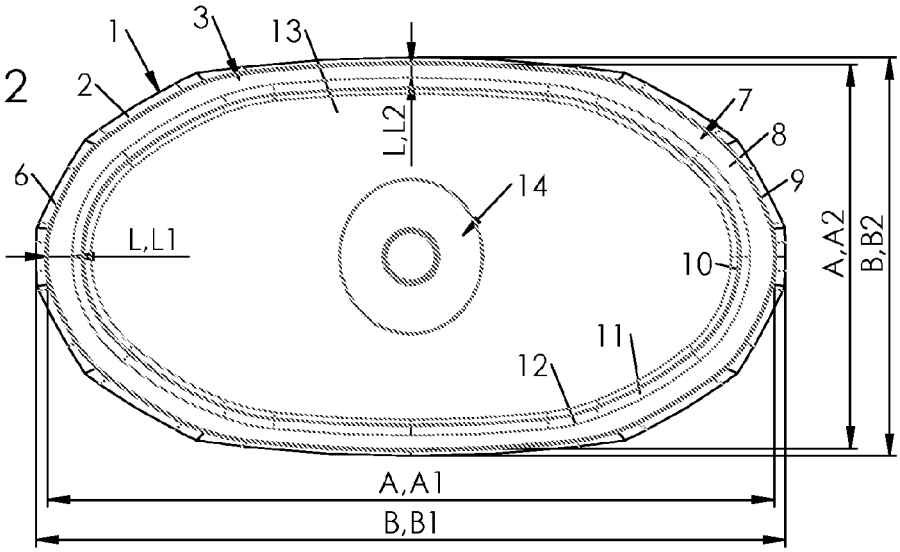
FIG. 2 is a bottom view of the bottom of the container of FIG. 1.

According to a preferred embodiment illustrated in FIGS. 2, 3 and 4, the width L of the seating plane 8 is not constant along its perimeter 9, but has a maximum denoted L1, measured parallel to the large dimension A1, and a minimum denoted L2, measured parallel to the small dimension A2, the ratio of which must be greater than 1:

$$\frac{L1}{L2} > 1$$

In other words, the seating plane 8 is wider parallel to the large dimension A1 than parallel to the small dimension A2. This greater width relative to the seating plane 8 in the larger dimension contributes to good blowability of the bottom 3 in this direction, minimizing the risk of appearance of distortions (or flatness defects) on the seating plane 8.

Moreover, the narrowness of the seating plane 8 in the small dimension gives said seating plane a quasi-linear character that decreases the risks of hyperstatism of the seat 7 and consequently increases the stability of the container 1.

Preferably, the ratio L1/L2 is between 1 and 3:

$$1 < \frac{L1}{L2} < 3$$

According to an embodiment illustrated in FIG. 1, this ratio is equal to approximately 2:

$$\frac{L_1}{L_2} \cong 2$$

Moreover, according to a preferred embodiment illustrated in FIGS. 3 and 4, the height H of the cheek 10 is not constant along the perimeter 9 of the seating plane 8, but has a minimum, denoted H1, measured parallel to the large dimension A1 of the seating plane, and a maximum, denoted H2, measured parallel to the small dimension A2, the ratio of which must be less than 1:

$$\frac{H1}{H2} < 1$$

preferably the ratio H1/H2 is between 0.5 and 1:

$$0.5 < \frac{H1}{H2} < 1$$

According to a particular embodiment illustrated in FIGS. 3 and 4, this ratio is approximately 0.95:

$$\frac{H1}{H2} \cong 0.95$$

Thus, the cheek 10 is higher in the plane of the small dimension A2 than in the plane of the large dimension A1. This characteristic contributes in particular:

- to a better blowability of the bottom 3 in the plane of the large dimension A1, while minimizing the quantity of material requiring an axial stretching;
- better rigidity of the arch 13, thanks to the variation of height of its outer perimeter (at its junction with the cheek 10);
- greater rigidity of the seat 7 parallel to the small dimension A2, to the benefit of its stability in this direction.

Thus, without compromising the stability, it is foreseeable that the container 1 could be flattened beyond a ratio A1/A2 (or B1/B2) greater than 1.5, to the benefit of the ergonomics. Preferably, the ratio A1/A2 (or B1/B2) must be greater than 1.8:

$$\frac{A1}{A2} > 1.8$$

Thus, according to a particular embodiment illustrated in particular in FIG. 2, the ratio A1/A2 is approximately 1.9:

$$\frac{A1}{A2} \cong 1.9$$

The variations, mentioned above, of the width L of the seating plane 8 and/or the height H of the cheek 10 can be expressed by a variation of the ratio L/H along the perimeter 9, with, preferably:

$$\frac{L2}{H2} < \frac{L1}{H1}$$

This inequality results in particular in the fact that:

- at a constant height H (H1=H2), the seating plane 8 is wider in the large dimension (L1>L2);
- at a constant width L1 of the seating plane 8 (L1=L2), the cheek 10 is higher in the small dimension (H2>H1).

The width of the seating plane 8, denoted $L_M$, can also be dimensioned at any point M of the outer perimeter 9 of the seating plane 8, as a function of the distance, denoted $C_M$, from the point M to the axis X of the container 1, preferably with:

$$\frac{1}{15} \leq \frac{L_M}{C_M} \leq \frac{1}{5}$$

Thus, the width of the seating plane 8 at any point remains small with respect to the distance to the axis X of the container 1. This guarantees a more homogeneous formation of the seat 7 during the blow-molding of the container 1, the material being distributed more uniformly over the periphery of the seating plane 8. The result is a better blowability of the container 1, and better stability thereof.

According to a preferred embodiment, the bottom 3 of the container 1 is formed by a stretch blow-molding method comprising a boxing operation, in a mold provided with a side wall defining an impression corresponding to the body 2 of the container 1, and a mold bottom that is movable with respect to the wall, in such a way as to cause an overstretching of the bottom 3, resulting in good rigidity and a good impression thereof.

The invention claimed is:

1. A container of plastic material, having a flattened body and a bottom in an extension of the body at a lower end thereof, the bottom comprising:

- a peripheral seat defining:
  - a seating plane the contour of which has in the same plane a large dimension A1 and a small dimension A2 that is smaller than the large dimension, and
  - an inner annular cheek substantially perpendicular to the seating plane;
- a concave arch that extends from the seat, in an extension of the cheek, towards a central zone of the bottom defining a disc that extends axially, projecting towards an interior of the container;

wherein:

- a height H of the cheek and a width L of the seating plane are such that:

$$0.5 \leq \frac{L}{H} \leq 2.5$$

- a transverse extension A of the seating plane and a corresponding transverse extension B of the body, measured near the bottom, are such that:

$$\frac{A}{B} \geq 0.85;$$

and wherein the seating plane has a maximum width L1, measured parallel to the large dimension A1, and a minimum width L2, measured parallel to the small dimension A2, and the ratio L1/L2 is greater than 1.

2. The container according to claim 1, wherein the small dimension A2 of the seating plane and a corresponding small dimension B2 of the body near the bottom are such that:

$$\frac{A2}{B2} \geq 0.90.$$

3. The container according to claim 2, wherein the small dimension A2 of the seating plane and the small dimension B2 of the body near the bottom are such that:

$$\frac{A2}{B2} \cong 0.95.$$

4. The container according to claim 1, wherein the maximum width L1 and the minimum width L2 of the seating plane are such that:

$$1 < \frac{L1}{L2} < 3.$$

5. The container according to claim 4, wherein the maximum width L1 and the minimum width L2 of the seating plane are such that:

$$\frac{L1}{L2} \cong 2.$$

6. The container according to claim 1, wherein the cheek has, parallel to the large dimension, a minimum height H1, and parallel to the small dimension, a maximum height H2 such that:

$$\frac{H1}{H2} < 1.$$

7. The container according to claim 6, wherein the minimum height H1 and the maximum height H2 of the cheek are such that:

$$0.5 < \frac{H1}{H2} < 1.$$

8. The container according to claim 7, wherein the minimum height H1 and the maximum height H2 of the cheek are such that:

$$\frac{H1}{H2} \cong 0.95.$$

9. The container according to claim 1, wherein the large dimension A1 and the small dimension A2 of the seating plane are such that:

$$\frac{A1}{A2} > 1.5.$$

10. The container according to claim 9, wherein the large dimension A1 and the small dimension A2 of the seating plane (8) are such that:

$$\frac{A1}{A2} > 1.8.$$

11. The container according to claim 1, wherein at any point M on an outer perimeter of the seating plane, the width $L_M$ of the seating plane is such that:

$$\frac{1}{15} \leq \frac{L_M}{C_M} \leq \frac{1}{5}$$

where $C_M$ is the distance from the point M to an axis of the container.

12. A container of plastic material, having a flattened body and a bottom in the extension of the body at a lower end thereof, the bottom comprising:

a peripheral seat lying in a seating plane, the seat defined by a contour having in the seating plane and passing through a vertical axis of the container a transverse maximum length A1 and a transverse minimum length A2, and an inner annular cheek substantially perpendicular to the seating plane; and a concave arch that extends from the seat, in an extension of the cheek, towards a central zone of the bottom defining a disc;

wherein a height H of the cheek and a width L of the seating plane at a location where the height of the cheek is measured are such that:

$$0.5 \leq \frac{L}{H} \leq 2.5$$

a transverse extension A of the seating plane passing through the vertical axis of the container and a corresponding transverse extension B of the body passing through the vertical axis of the container, measured at or near the bottom are such that:

$$\frac{A}{B} \geq 0.85;$$

and the seating plane has a maximum width L1, measured along the transverse maximum length A1 and a minimum width L2, measured along the transverse minimum length A2, and the ratio L1/L2 is greater than 1.

* * * * *